US006651840B1

(12) United States Patent
Van Dullemen et al.

(10) Patent No.: US 6,651,840 B1
(45) Date of Patent: Nov. 25, 2003

(54) APPARATUS FOR DISPENSING PILLS, AS WELL AS DISPENSER AND PILLPACK FOR USE THEREIN

(75) Inventors: Marlies Van Dullemen, Leiden (NL); Mark Herman Hendrik Schulte, Leiden (NL)

(73) Assignee: Akzo Nobel NV, BM Arnhem (NL)

( * ) Notice: Subject to any disclaimer, the term of this patent is extended or adjusted under 35 U.S.C. 154(b) by 0 days.

(21) Appl. No.: 09/762,998

(22) PCT Filed: Aug. 16, 1999

(86) PCT No.: PCT/NL99/00519

§ 371 (c)(1),
(2), (4) Date: Feb. 15, 2001

(87) PCT Pub. No.: WO00/09419

PCT Pub. Date: Feb. 24, 2000

(30) Foreign Application Priority Data

Aug. 17, 1998 (NL) ..... 1009878

(51) Int. Cl.[7] ..... G07F 11/00
(52) U.S. Cl. ..... 221/88; 221/197
(58) Field of Search ..... 221/2, 1, 25, 31, 221/30, 79, 81, 88, 197, 287

(56) References Cited

U.S. PATENT DOCUMENTS

| | | | | | |
|---|---|---|---|---|---|
| 3,651,927 | A | | 3/1972 | Richardson et al. | 206/42 |
| 4,015,717 | A | | 4/1977 | Richardson et al. | 206/534 |
| 4,646,936 | A | * | 3/1987 | Frazier et al. | 221/25 |
| 4,667,845 | A | | 5/1987 | Frazier et al. | 221/5 |
| 5,405,011 | A | * | 4/1995 | Haber et al. | 221/25 |
| 5,409,132 | A | | 4/1995 | Kooijmans et al. | 221/86 |
| 6,039,208 | A | * | 3/2000 | Lambelet, Jr. | 221/197 |
| 6,062,420 | A | * | 5/2000 | Krouwel et al. | 221/88 |
| 6,138,866 | A | * | 10/2000 | Lambelet et al. | 221/197 |
| 6,193,103 | B1 | * | 2/2001 | Clarijs | 221/197 |
| 6,234,343 | B1 | * | 5/2001 | Papp | 221/197 |

FOREIGN PATENT DOCUMENTS

| | | |
|---|---|---|
| EP | 0 807 589 | 11/1997 |
| FR | 2 538 791 | 12/1982 |
| WO | WO 94/08873 | 4/1994 |
| WO | WO 97/08078 | 3/1997 |

* cited by examiner

*Primary Examiner*—Kenneth W. Noland
(74) *Attorney, Agent, or Firm*—St. Onge Steward Johnston & Reens LLC

(57) ABSTRACT

An apparatus for dispensing pills comprises at least one ring-shaped blister pack, in which cavities containing pills are distributed, such that the openings of the cavities therein are directed outwardly, as well as a flat pocket dispenser. It has a first part for receiving the pack in a ring shape, and a second part fitting onto the first part and encasing the blister pack together with the first part. The first part and/or the second part comprises at least one passage opening with which a pill to be dispensed can be aligned. A push-out means can be positioned in line with the respective pills of the blister pack and with the passage opening and be operated for pushing out the pill to be dispensed through the passage opening. There are provided means for rotatably positioning the blister pack stepwise relative to the part of the apparatus including the push-out means. The blister pack itself and the part containing the push-out means comprise the means for the stepwise positioning of the blister pack.

19 Claims, 5 Drawing Sheets

APPARATUS FOR DISPENSING PILLS, AS WELL AS DISPENSER AND PILLPACK FOR USE THEREIN

The invention relates to an apparatus for dispensing pills comprising at least one pill package and a dispenser.

The patent literature includes a great many publications relating to pocket dispensers with pill packages. Examples thereof are: U.S. Pat. Nos. 4,667,845; 3,651,927; EP-A-0 807 589; FR-A-2 538 791; U.S. Pat. Nos. 5,409,132; 4,015, 717.

Such an apparatus comprising a pocket dispenser and pill package is also known from international patent application WO 97/08078 of applicant. In this prior art apparatus, the means for the stepwise rotatable positioning of the pill package in the form of a blister pack are mounted on both parts of the dispenser, whilst the blister pack is in non-rotatable engagement with one of said parts, as a result of which it is carried along upon rotation thereof.

The object of the invention is to further improve the known apparatus.

In order to accomplish that objective, the invention provides an apparatus for dispensing pills comprising at least one ring-shaped pill package, in which cavities containing pills are so distributed that the openings of the cavities therein are directed outwardly, as well as a flat pocket dispenser comprising a first part for receiving the pill package in a ring shape, a second part fitting on said first part, which envelops the pill package together with the first part, which first part and/or which second part comprise(s) at least one passage opening with which a pill to be dispensed can be aligned, and a push-out means, which can be positioned in line with the respective pills in the pill package and with the passage opening and which can be operated for pushing out the pill to be dispensed through the passage opening, wherein means are provided for rotatably positioning the pill package stepwise relative to the part of the apparatus including the push-out means, characterized in that the pill package itself and the part of the dispenser that includes the push-out means comprise means for the stepwise positioning of the pill package.

By mounting the means for the stepwise positioning of the pill package directly on the pill package itself, one source of inaccuracies in the positioning of the pill package relative to the push-out means is eliminated. The fact is that it has become apparent that it is very important that the cavity containing the pill to be dispensed be accurately positioned in line with the push-out means in order to ensure that the pill is ejected from the cavity and, in cases where a blister pack is used as the pill package, through the covering foil in a reliable manner. This plays a role in particular when the dimensions of the apparatus are to be reduced. The small dimensions impose restrictions on the stroke of the push-out means, the ejection force, the blister size and the like.

In order to achieve a further enhancement of the accuracy, said means are fitted with a biassing element, which eliminates the play in said means that are imposed by the production process to one side.

In one possible embodiment, said means comprise teeth formed on the respective part of the dispenser and a spring tooth formed on the pill package, wherein the biassing element preferably comprises a second tooth which is spaced from the former tooth in circumferential direction by a distance which slightly deviates from (a multiple of) the pitch of the teeth on the dispenser.

When said means and said biassing element are formed on the pill package, they can be used not only for positioning the pill package in the dispenser, but also, in the case of a holder containing a blister pack, for positioning the blister pack correctly relative to the holder during production.

In order to further improve the ejection performance of the push-out means, the outwardly extending free end of said push-out means is bevelled, such that each cavity is loaded off-centre upon ejection of a pill.

Surprisingly, it has become apparent that when the cavity of a blister pack is loaded in this manner, the pill can be ejected from the cavity in a controlled manner, without peaks in the development of force which might have a negative influence on the ejection movement. Furthermore, the average ejection force will remain low.

According to another aspect of the invention, the push-out means can be operated by means of the operating element, wherein the push-out means and the operating element are in one piece, albeit in the form of two parts interconnected by a film joint, whilst the part of the dispenser that supports the operating element includes means for imposing the pivoting movement.

When such a push-out means and such an operating element are used, both the movement of the operating element and that of the push-out means can be selected at will without any additional parts being required.

Another advantageous aspect of the invention is the fact that the blister pack may be provided with means, which may for example be visible through the passage opening, for providing an indication as to the contents of the cavity in the blister pack that is positioned in line with the passage opening. Said means may for example consist of a colour code, which indicates whether or not, in the case of an anti-conception pill, the omission to take a pill involves a risk of conception.

The invention will be explained in more detail hereafter with reference to the drawings, which schematically show an embodiment of the invention.

Figure 1:
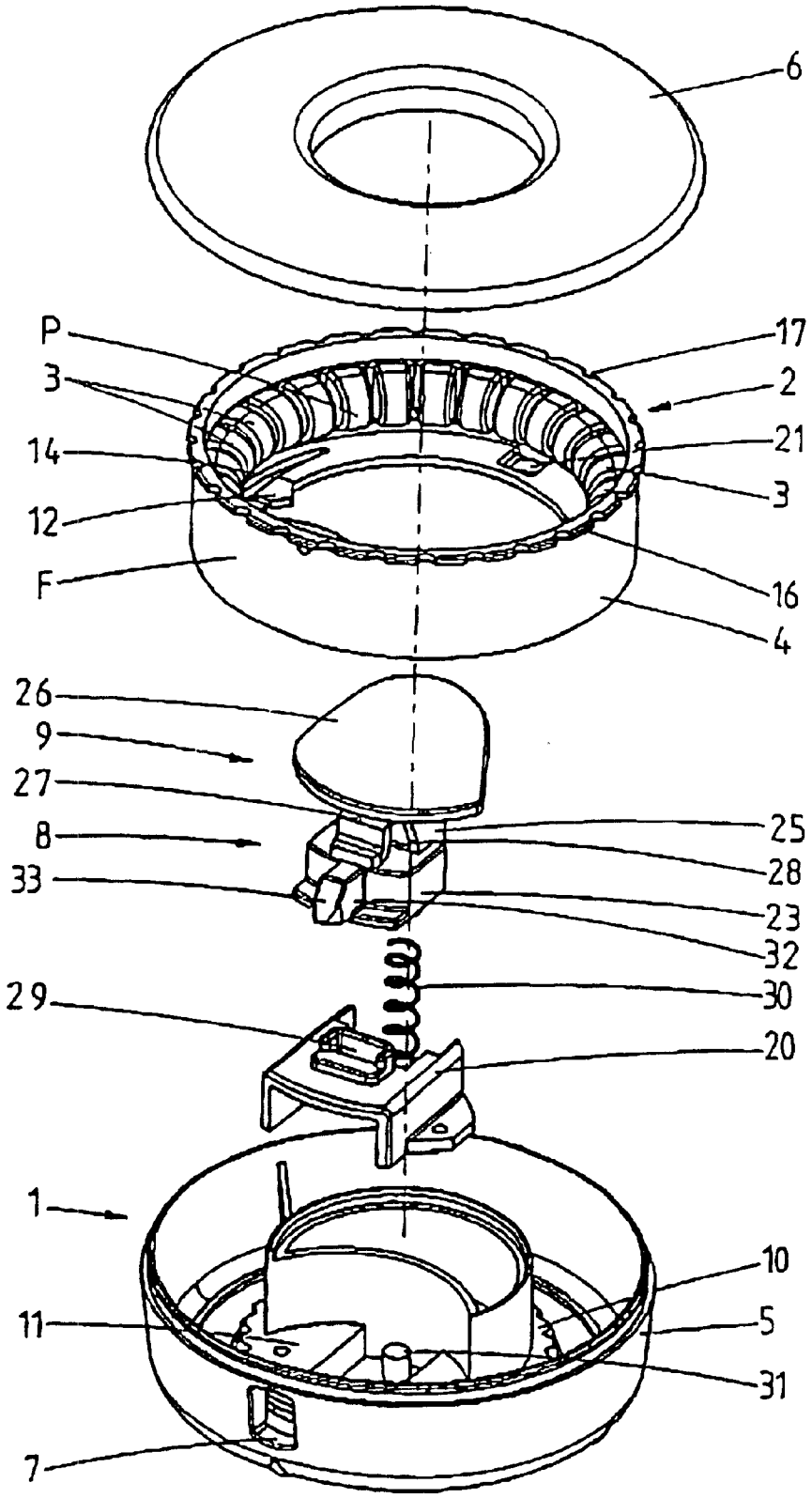
FIG. 1 is a perspective, exploded view of the embodiment of the apparatus according to the invention comprising a dispenser and a blister pack.

The drawing shows an embodiment of an apparatus for dispensing pills comprising a pocket dispenser 1 intended for repeated use and a pill package, in this case in the form of a disposable blister pack 2. In the illustrated embodiment, the pills in the blister pack 2 are anti-conception pills, one package containing 28 such pills. The dispenser can also be used for other pills, of course.

Figure 6:
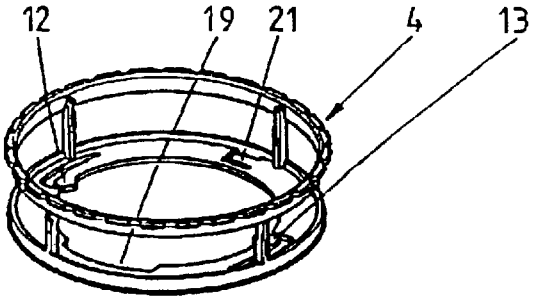
FIG. 6 is a perspective view of the holder for the blister pack according to FIG. 1.

Blister pack 2 comprises a body having a plurality of cavities 3 for receiving one pill P each (in this embodiment). In this embodiment, cavities 3 are covered by a frangible foil F (see FIGS. 1, 9 and 10), such that when a force is exerted on cavity 3 containing pill P, the pill can be pushed out through the frangible foil. In the illustrated embodiment, the blister pack 2 is accommodated in a holder 4 (see also FIG. 6) in a ring shape, such that foil F is disposed on the outer side of said ring and pill P can be ejected from the blister pack 2 from the inside, therefore.

Holder 4 may be formed in one piece with blister pack 2, or be joined to blister pack 2, for example by bending a rectangular blister pack 2 into a ring shape and subsequently attaching holder 4 or individual parts thereof to blister pack 2. Preferably, this is done as part of the manufacturing process. Holder 4 makes it very easy to place blister pack 2 into dispenser 1, whilst holder 4 may furthermore add functionality to the blister pack 2.

Figure 3:
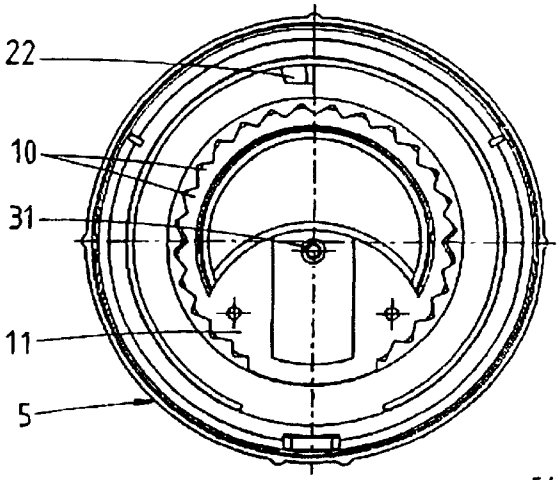
FIG. 3 is a top plan view of the lower part of the dispenser of FIG. 1.

As is shown in particular in FIG. 1, the dispenser 1 comprises a lower, cup-shaped part 5 and a cover-like upper part 6 to be placed on top of said part 5. The two parts 5, 6 have mating edges, which make it possible to snap upper part 6 onto lower part 5 so as to close dispenser 1, wherein the upper part 6 remains rotatable relative to the lower part 5. The circumferential edge of upper part 6 projects beyond the circumference of lower part 5 (see FIGS. 3 and 4) in order to make it easier to handle the dispenser for rotating it. The two parts 5 and 6 are substantially annular, having an opening in their centres and a circular circumference. Dispenser 1 is furthermore relatively flat, so that it can be readily carried along in a bag or in a pocket.

The lower part 5 of dispenser 1 has a passage opening 7 in its circumferential wall for ejecting a pill from dispenser 1, to which end the lower part 5 is also provided with a push-out means 8 comprising an operating element or button 9, which will be discussed in more detail yet.

In order to eject pills P, it must be possible to rotate the blister pack 2 stepwise relative to the lower part 5, such that a new cavity 3 containing a pill P can be placed between the push-out means 8 and the passage opening 7 each time, so that a pill can be ejected by the push-out means 8 upon actuation of the operating element 9.

Figure 2:
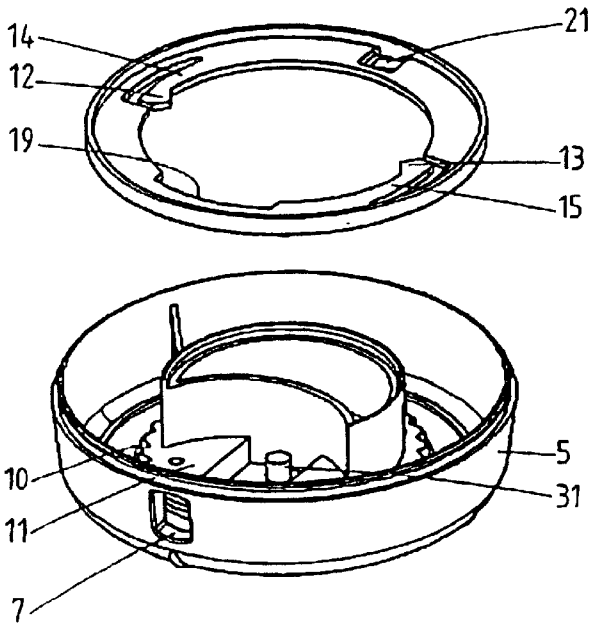
FIG. 2 is a view comparable with FIG. 1, showing the lower part of the dispenser and the lower part of the holder for the blister pack according to FIG. 1.

According to the invention, holder 4 of the blister pack 2 and the lower part 5 of the dispenser are to this end fitted with mating positioning means. The means of the lower part 5 consist of teeth 10, which are formed on the outer circumference of an elevation 11 on the bottom of lower part 5 (see FIGS. 1–3), whilst the means present on holder 4 consist of at least substantially radially opposed teeth 12 and 13, which are formed on spring arms 14 and 15, respectively, so that the teeth 12 and 13 can move resiliently in radial direction and thus snap between the teeth 10 on the dispenser so as to hold the blister pack in a predetermined position relative to the lower part 5 of dispenser 1. The number of teeth 10 corresponds to the number of cavities 3 in the blister pack 2, so that a new cavity 3 can be positioned before the passage opening 7 upon movement of teeth 12 and 13 to a next position. Teeth 10 are not formed symmetrically, but the flank located on the side of the correct direction of rotation is less steep, thus making rotation in the correct direction easier than rotation in the opposite direction or even making rotation in the wrong direction altogether impossible.

Figure 7:
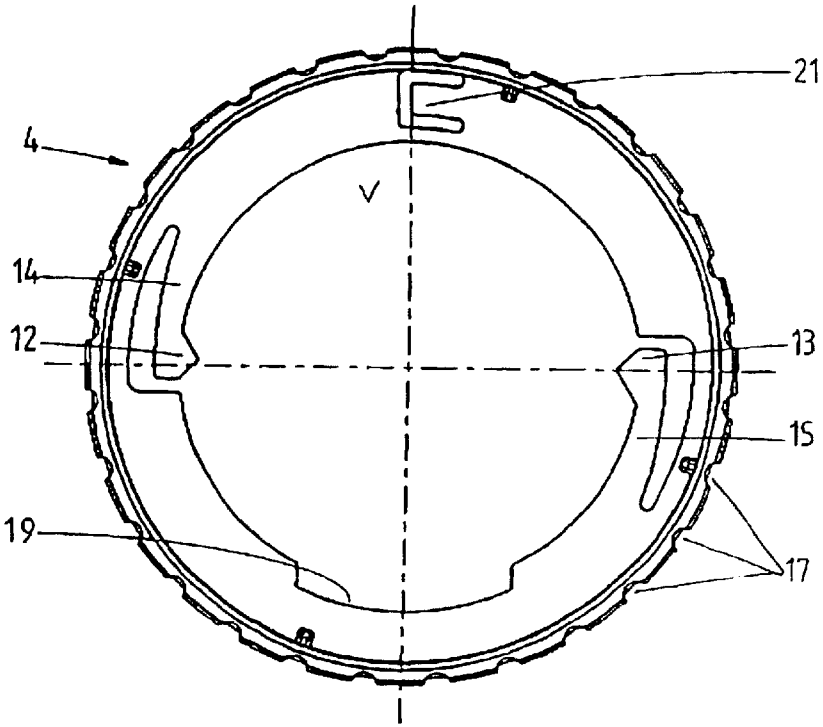
FIG. 7 is a top plan view of the holder of FIG. 6.

As is shown in FIG. 7, teeth 12 and 13 of holder 4 are not positioned exactly diametrically opposite each other, that is, the circumferential distance between teeth 12 and 13 does not exactly correspond to a multiple of the tooth pitch (in this case 180°), as a result of which the two teeth 12 and 13 will not engage exactly centrally between two teeth 10 at any time, but one of the teeth 12, 13 will abut against the sloping tooth flank of an adjacent tooth 10, thus exerting a force in circumferential direction on blister pack 2, as a result of which the play that is present is compensated. In the embodiment wherein the blister pack 2 is to be joined with holder 4, the teeth 12 and 13 can also be used as positioning means during manufacture or assembly for joining blister pack 2 and holder at the correct circumferential angle.

Figure 4:
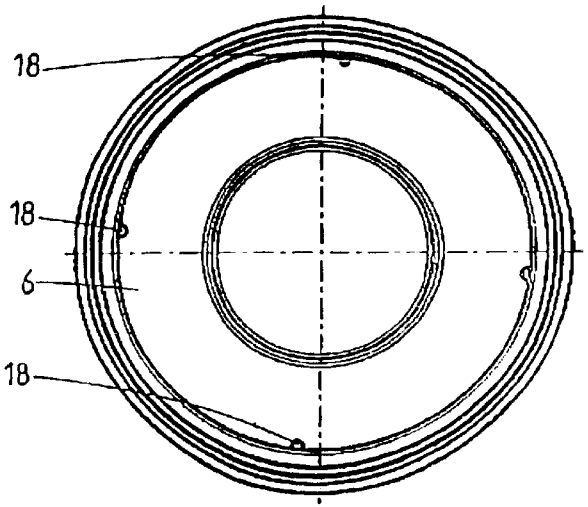
FIG. 4 is a bottom plan view of the upper part of the dispenser of FIG. 1.
Figure 5:
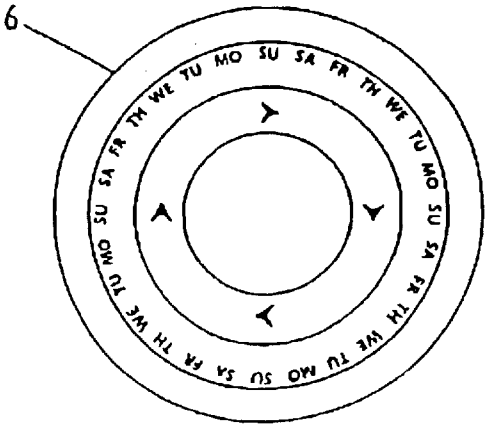
FIG. 5 is a top plan view of the upper part of the dispenser of FIG. 1.

Holder 4 and the upper part 6 of dispenser 1 also include positioning means for non-rotatably interconnecting the upper part 6 and the blister pack 2 in several positions, so as to be able to rotate holder 4 and blister pack 2 with respect to the lower part 5 of dispenser 5 by means of upper part 6. To this end a short, outwardly extending flanged edge 16 including a number of notches 17 corresponding to the number of cavities 3 in blister pack 2 (FIGS. 1, 6 and 7) is formed on the upper edge of holder 4 of blister pack 2. The upper part 6 of dispenser 1 includes one or more projections 18, four in this case, which fit(s) in notches 17 (FIG. 4). The position of the upper part 6 relative to the blister pack 2 is determined by the day on which the first pill P is taken, whereby the indication of the day or the date that the first pill is taken, which is present on the transparent upper part 6 (FIG. 5), is placed at the position of the first pill, wherein the various pills are numbered on the blister pack. There are several possible ways of providing the indication of the day on first part 6 as part of the manufacturing process, whereby the design must be such that the indication of the day can be easily aligned with the pills. This indication of the day makes it easier to check whether or not the pill associated with that particular day has already been taken.

Preferably, the foil F of blister pack 2 is provided with an indication, preferably a colour code, which indicates whether or not the omission to take the pill present in the associated cavity in time involves a risk of conception. In the present case, the foil of blister pack 2 will have a clearly recognizable colour or colours, for example red, which is visible through the passage opening 7 at the location of cavities 3 containing active pills P, whilst the foil will for example be green at the location of cavities 3 containing pills to be taken on days that the omission to take one involves only a small risk of conception, or none at all. In this way a user is immediately alarmed or reassured, as the case may be, when she has forgotten to take a pill.

In order to place the blister pack 2 into the lower part 5 of dispenser 1 in the correct manner, such that the first pill to be taken will be aligned with passage opening 7, the annular bottom of holder 4 of blister pack 2 is provided with a recess 19 in its inner circumference (see FIGS. 2 and 7), which must be positioned on elevation 11 on the bottom of lower part 5 at the location of an attachment 20 (FIG. 1) in order to be able to place blister pack 2 into the lower part 5 of the dispenser 1.

In order to ensure that the blister pack 2 is rotated in the correct direction from this starting position, so as to start the correct sequence of pills, a sloping lip 21 is formed in the bottom of holder 4 (FIGS. 2 and 7), which lip extends obliquely downwards from one side in the circumferential direction and which engages in a recess 22 (FIG. 3) in the bottom of lower part 5 in the starting position of blister pack 2. When the upper part 6 of dispenser 1 containing the blister pack 2 is rotated in the wrong direction, the free end of lip 21 will strike against the radial wall of recess 22, thus preventing rotation in that direction whilst enabling rotation in the opposite, correct direction, because the spring lip 21 is lifted from recess 22 as a result of the wedge shape. In other positions, however, it is possible to rotate blister pack 2 back, for example when blister pack 2 has been rotated too far, because the free end of lip 21 will then slide across the smooth bottom of the lower part 5 of the dispenser.

Figure 8:
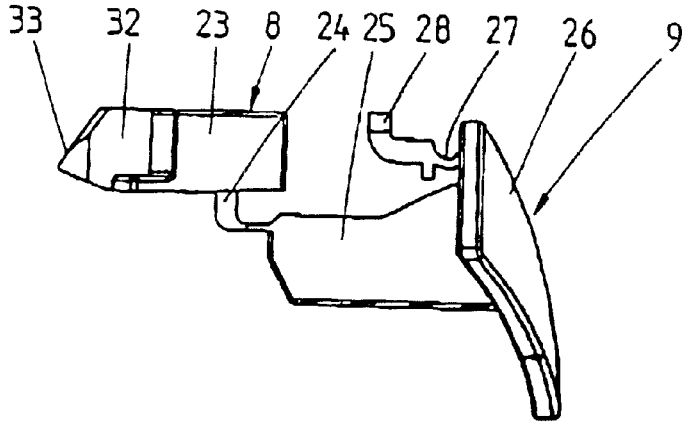
FIG. 8 is a larger-scale side view, showing the push-out means of FIG. 1 in the unfolded position in which it is manufacture.
Figure 9:
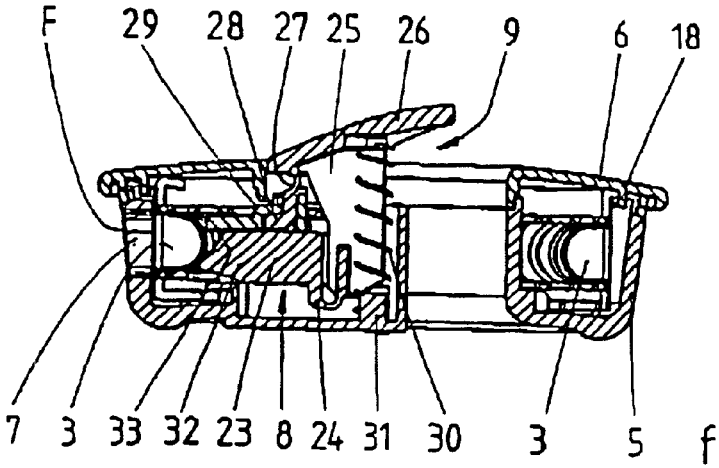
FIGS. 9 and 10 are cross-sectional views of the apparatus according to FIG. 1, showing the push-out means in, respectively, the position of rest and the ejection position.
Figure 10:
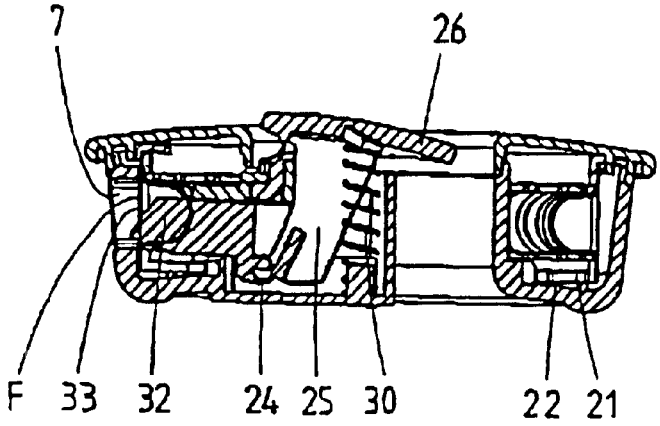

FIGS. 8, 9 and 10 show the push-out means 8 and the operating element 9 of FIG. 1 and the operation thereof. Push-out means 8 is guided to be moved radially in the lower part 5 of dispenser 1 by means of elevation 11 on the bottom of lower part 5 and the attachment 20 mounted thereon, which is in the shape of an inverted U and which engages over a guide web 23 of push-out means 8. Push-out means 8 is integrally connected and integrally formed with the operating element 9 via a film hinge 24, which is formed on the lower inward end of push-out means 8 and on the lower end of operating element 9. Operating element 9 comprises a connecting web 25 and a pressure surface 26 on the upper end thereof, which pressure surface 26 can for example be operated with a thumb. The operating element 9 will thereby pivot about a film hinge 27 present on the front outward end of pressure surface 26. Said film hinge 27 allows pivoting movement relative to a mounting element 28, which is capable of hooking into a cooperating receiving element 29 present on top of the web of attachment 20 so as to secure mounting element 28 in position and pivotally connect operating element 9. Operating element 9 is spring-loaded towards its upper position of rest by a spring member, in this case a helical compression spring 30, whose lower end surrounds a cam 31 on the bottom of lower part 5 of dispenser 1 and whose upper end butts against the underside of pressure surface 26 of operating element 9.

Push-out means 8 is fitted with an ejector nose 32 for ejecting pills P, which nose fits in passage opening 7, which slightly tapers off in the ejecting direction and which includes a sloping ejection surface 33, which is capable of engaging each cavity 3 of blister pack 2 off-centre and of deforming cavity 3 by pressure, pushing the pill P that is present in cavity 3 outwards through foil F and subsequently out of the dispenser 1 through passage opening 7. Cavity 3 can be easily deformed, without force peaks, by loading the cavity 3 off-centre with a sloping ejection surface 33, as a result of which the pill P present in cavity 3 can be ejected in a controlled manner, which leads to pills P being dispensed in a reliable manner. As a result of the accurate positioning of the blister pack 2 relative to the lower part 5 of dispenser 1 by means of teeth 10 and teeth 12, 13, a cavity 3 will be accurately positioned at the same place before the ejector nose 32 of push-out means 8 at all times, so that each cavity 3 is identically loaded by the ejection surface 33 and dispensing of pills takes place in a constant manner. Thus, a reliable operation of the apparatus is obtained.

Push-out means 8 and operating element 9 may be shaped such that a transmission ratio higher than one is obtained, in which case a movement of operating element 9 will result in a greater movement of push-out means 8. This enables a further reduction of the size of the dispenser. Due to the advantageous ejection behaviour and the relatively low ejection forces that are required, the large transmission ratio does not lead to uncomfortably large operating forces on operating element 9.

Figure 12:
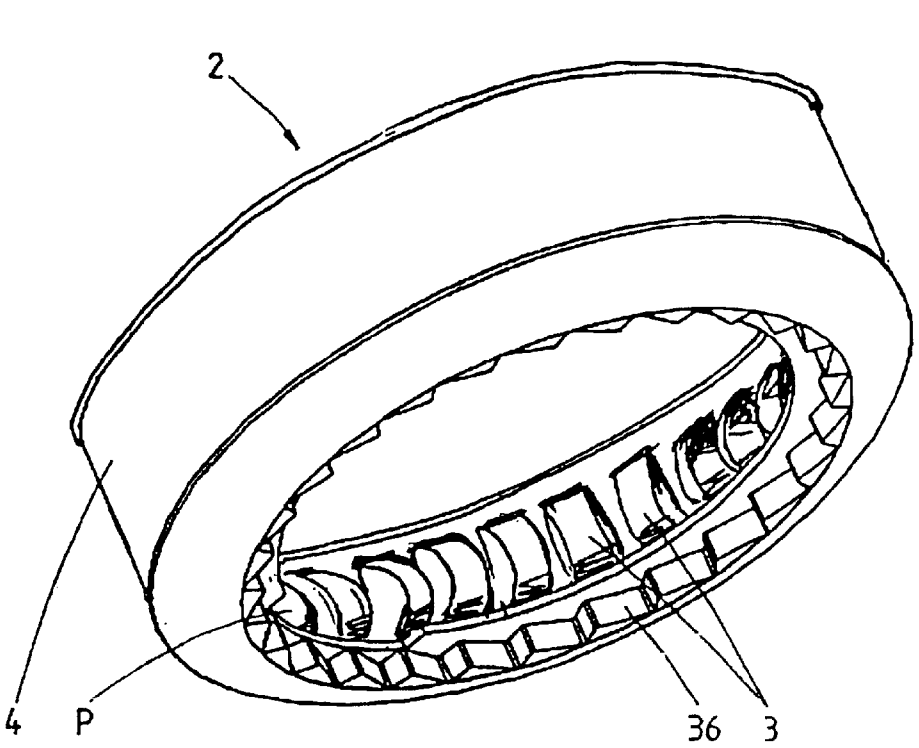
FIG. 12 is a perspective bottom plan view of a pill package for use in the dispenser of FIG. 11.
Figure 11:
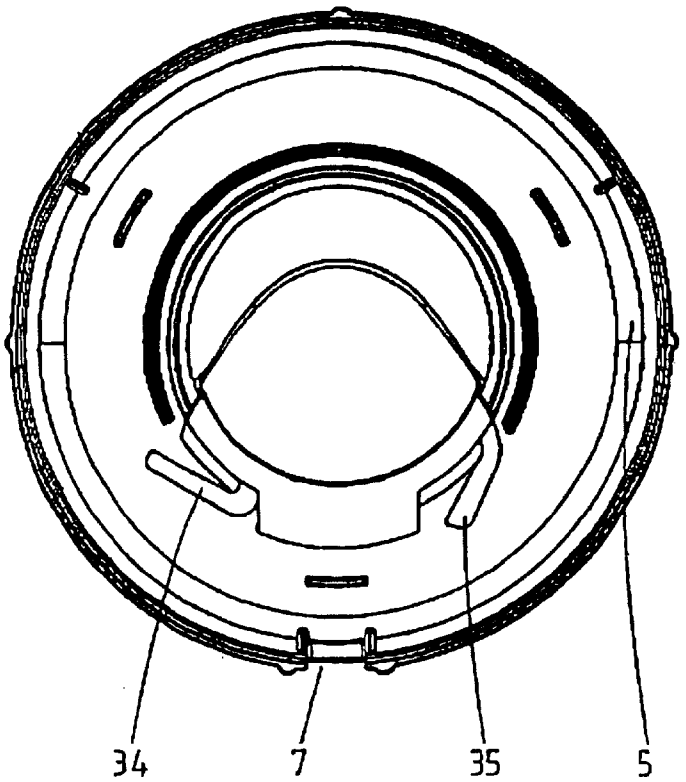
FIG. 11 is a top plan view corresponding with FIG. 3 of the lower part of an embodiment of the dispenser of FIG. 1.

FIGS. 11 and 12 show another variant of the dispenser 1 and the pill package 2 according to the invention, wherein means for the stepwise positioning of the pill package 2 relative to the lower part 5 of the dispenser 1 are kinematically reversed in comparison with the embodiment of FIG. 1. The embodiment of FIGS. 11 and 12 also comprises two spring teeth or fingers, 34 and 35 in this embodiment, and teeth 36, but the spring teeth 34, 36 are mounted on the lower part 5 of dispenser 1, whilst teeth 36 are formed on pill package 2. The operation is essentially the same as that of the embodiment described before.

From the foregoing it will be apparent that the invention provides an apparatus for dispensing pills which is remarkable for its simplicity and compact construction comprising a minimum number of components whilst providing a reliable operation.

The invention is not restricted to the above-described embodiment as shown in the drawings, which can be varied in several ways without departing from the scope of the invention. Thus it is for example possible to leave out the attachment 20 in the lower part 5 of the dispenser 1 and to form the receiving element 29 and the guide for the push-out element 8 on lower part 5. In that case, the pill package may be a disposable package other than a blister pack. The operating element and the push-out means may also consist of two interlocking parts, for example parts which are snapped together.

What is claimed is:

1. Apparatus for dispensing pills comprising:

at least one pill package, said pill package having cavities containing pills, said cavities having openings oriented such that said openings of the cavities are directed outwardly, a flat pocket dispenser further comprising a first part for receiving said pill package, a second part fitting on said first part, said first and said second part enveloping said pill package, at least one of said first part and said second part having at least one passage opening with which a pill to be dispensed can be aligned, a push-out member provided in one of said first and second parts, aligned with the said pills in the pill package and with the passage opening, and which can be operated for pushing out the pill to be dispensed through the passage opening, wherein said pill package and one of said first and second parts comprise positioning elements for rotatably positioning the pill package relative to said push-out member.

2. Apparatus according to claim 1, wherein said positioning elements include a biasing element which eliminates the play in said positioning elements in one direction of rotation of said pill package.

3. Apparatus according to claim 1, wherein said positioning elements comprise teeth formed on said first part and a spring tooth connected to said pill package.

4. Apparatus according to claim 2, wherein said positioning elements comprise teeth formed on said first part, and said biasing element further comprising a first spring tooth and a second spring tooth spaced from each other in circumferential direction by a distance which slightly deviates from a multiple of the pitch of said teeth formed on said first part.

5. Apparatus according to claim 1, wherein said pill package is a blister pack, and wherein said push-out member includes an outwardly extending free end with an ejector nose, said ejector nose having a sloping ejection surface such that when a pill is ejected from said apparatus, each cavity of said blister pack is loaded by said ejection surface off-centered in a circumferential direction with respect to a center line of the cavity in a push-out direction.

6. Apparatus according to claim 1, wherein said pill package and said one of said first and second parts include locking elements for preventing rotation in a direction opposed to a desired direction of rotation in a starting position of the pill package, but permitting rotation in a direction opposed to the desired direction of rotation when said pill package is not at said starting position.

7. Apparatus according to claim 6, wherein said locking elements include a sloping spring lip and a mating recess, which are formed on the pill package and on the dispenser, respectively.

8. Apparatus according to claim 1, wherein said pill package is a blister pack, including a premounted holder, said holder includes said position elements.

9. Apparatus according to claim 1, wherein said second part of said dispenser is provided with an indication of the times at said a pill is to be taken, said time indications are arranged to corresponding to the arrangement of the cavities in the pill package, and wherein said second part can be brought into non-rotatable engagement with said pill package in several positions.

10. Apparatus according to claim 1, wherein said pill package and one of said first and said second parts include positioning means which ensure that the pill package can only be placed into the dispenser in a predetermined position.

11. Apparatus according to claim 1, wherein said pill package comprises cavities for holding pills in a ring shape relative to each other, said pill package further comprises positioning elements for rotatably positioning said pill package relative to said push-out member.

12. Apparatus for dispensing pills comprising a pill package having cavities containing pills, said cavities being positioned such that the openings of said cavities are directed radially outward, said apparatus further comprising a first part for receiving said pill package, a second part fitting on said first part, which envelops said pill package together with said first part, at least one of said first part and said second part comprising at least one passage opening with which a pill to be dispensed can be aligned, a push-out member provided in one of said first or second parts, said push-out member being positionable in line with said pills and with said passage opening, said push-out member operated by an operating element for pushing out said pill to be dispensed through said passage opening, said operating element further comprising a pivoted push button, which is drivingly connected to the push-out member and one of said first and second parts that including the push-out member includes a mechanism for imposing a pivoting movement to the operating element when it is operated.

13. An apparatus according to claim 12, wherein said operating element is pivotally supported by one of said first and second parts of said dispenser that includes said push-out member and said push-out member is accommodated in a radial guide.

14. An apparatus according to claim 13, wherein an attachment is mounted in one of said first and second parts of said dispenser parts, said attachment functions as a guide for said push-out member and as a support for said operating element, wherein the operating element includes a hinge which enables said operator element to pivot relative to said attachment.

15. A pocket dispenser for dispensing pills from a pill package, said pill package being a blister pack, having cavities containing pills, said cavities being distributed such that each cavity has an opening in the radial direction, said dispenser further comprising a first lower part for supporting said pill package, a second upper part fitting on said first lower part and envelops the pill package together with said lower part, said dispenser further comprises at least one passage opening in a radial direction with which a pill to be dispensed can be aligned, and a push-out member which can be positioned in line with the a pill in said package and with the passage opening said push-out member can be operated to move in radial direction for pushing out the pill to be dispensed through the passage opening, said push-out member including an ejector nose having an ejection surface, such that upon ejection of a pill, one of said cavities is loaded off-centre in an axial direction with respect to a radial central plane through the cavity.

16. Apparatus for dispensing pills comprising a pill package, said pill package being a blister pack, said blister pack having cavities containing pills, a housing which houses said pill package, said housing having at least one passage opening with which a pill to be dispensed can be aligned, and a push-out members which can be positioned in line with said pills and with said passage opening, said push-out member being operable in a radial direction to push out the pill through said passage opening, said blister pack further comprising indicia visible through said passage opening for indicating relative health risk of not taking pill in said cavity aligned with said passage opening.

17. Apparatus according to claim 16, wherein said indicia is a color.

18. Apparatus according to claim 17, further comprising a blister pack having a plurality of cavities for receiving pills, as well as a frangible cover foil covering said cavities, said cover foil having a color code for each cavity, said color code provides an indication relating to the respective underlying cavity.

19. The blister pack of claim 18, wherein said color code is red and green, red indicating a high risk and green indicating a low risk.

* * * * *